US010900269B2

(12) United States Patent
Holzapfel et al.

(10) Patent No.: US 10,900,269 B2
(45) Date of Patent: Jan. 26, 2021

(54) ACTUATING ARM DRIVE

(71) Applicant: Julius Blum GmbH, Hoechst (AT)

(72) Inventors: Andreas Holzapfel, Bregenz (AT); Philip Schluge, Dornbirn (AT)

(73) Assignee: JULIUS BLUM GMBH, Hoechst (AT)

( * ) Notice: Subject to any disclaimer, the term of this patent is extended or adjusted under 35 U.S.C. 154(b) by 2 days.

(21) Appl. No.: 16/109,012

(22) Filed: Aug. 22, 2018

(65) Prior Publication Data

US 2018/0363346 A1 Dec. 20, 2018

Related U.S. Application Data

(63) Continuation of application No. PCT/AT2017/060048, filed on Feb. 27, 2017.

(30) Foreign Application Priority Data

Feb. 26, 2016 (AT) ..... A 50145/2016

(51) Int. Cl.
*E05F 1/10* (2006.01)

(52) U.S. Cl.
CPC ..... *E05F 1/1058* (2013.01); *E05F 1/1075* (2013.01); *E05Y 2201/624* (2013.01);
(Continued)

(58) Field of Classification Search
CPC ..... Y10T 16/53824; Y10T 16/53864; Y10T 16/547; Y10T 16/53832; Y10T 16/5404;
(Continued)

(56) References Cited

U.S. PATENT DOCUMENTS 2,206,708 A * 7/1940 Stumpf ..... E05D 3/06 16/358
2,674,761 A 4/1954 Weiss
(Continued)

FOREIGN PATENT DOCUMENTS

CN 103465746 12/2013
DE 26 13 661 10/1977
(Continued)

OTHER PUBLICATIONS

International Search Report dated May 29, 2017 in International (PCT) Application No. PCT/AT2017/060048.
(Continued)

*Primary Examiner* — Victor D Batson
*Assistant Examiner* — Matthew J Sullivan
(74) *Attorney, Agent, or Firm* — Wenderoth, Lind & Ponack, L.L.P.

(57) ABSTRACT

An actuating arm drive for a pivotably mounted actuating arm, in particular for driving a flap of a piece of furniture, includes a plurality of articulatedly interconnected levers. A first lever and a second lever of the actuating arm drive are arranged parallel to one another with a lateral spacing, and the levers each have two axial bores with a first standard spacing, through each of which bores an axial pin projects. A third lever has receptacles for the axial pins with a second standard spacing, and the second standard spacing is different than the first standard spacing. The axial pins each project through the axial bores of the first and second lever and are at least partially received in the receptacles of the third lever.

25 Claims, 16 Drawing Sheets

(52) U.S. Cl.
CPC ..... *E05Y 2201/626* (2013.01); *E05Y 2800/21* (2013.01); *E05Y 2800/22* (2013.01); *E05Y 2800/242* (2013.01); *E05Y 2800/266* (2013.01); *E05Y 2800/344* (2013.01); *E05Y 2800/465* (2013.01); *E05Y 2900/20* (2013.01)

(58) Field of Classification Search
CPC ..... Y10T 16/54052; E05D 3/14; E05D 3/06; E05D 3/08; E05Y 2900/20; E05F 1/1058; E05F 1/1075
See application file for complete search history.

(56) References Cited

U.S. PATENT DOCUMENTS

| | | | | |
|---|---|---|---|---|
| 5,033,160 | A | 7/1991 | Salice | |
| 6,386,621 | B1 * | 5/2002 | Kozak | B60J 5/047 16/278 |
| 6,647,592 | B2 * | 11/2003 | Presley | E05D 3/145 16/288 |
| 6,681,448 | B2 * | 1/2004 | Liang | E05D 3/147 16/334 |
| 6,997,504 | B1 * | 2/2006 | Lang | E05D 3/127 16/334 |
| 8,807,670 | B2 | 8/2014 | Blum | |
| 9,277,817 | B2 | 3/2016 | Blum | |
| 9,719,283 | B2 | 8/2017 | Holzapfel | |
| 9,777,522 | B2 * | 10/2017 | Dey | E05D 11/1014 |
| 10,407,962 | B2 | 9/2019 | Schluge | |
| 2003/0056324 | A1 | 3/2003 | Yazawa et al. | |
| 2006/0028049 | A1 | 2/2006 | Lang et al. | |
| 2012/0161598 | A1 | 6/2012 | Blum | |
| 2013/0033620 | A1 | 2/2013 | Polidor et al. | |
| 2013/0328283 | A1 | 12/2013 | Korte et al. | |
| 2014/0319987 | A1 | 10/2014 | Blum | |
| 2017/0044812 | A1 | 2/2017 | Schluge | |
| 2019/0234127 | A1 * | 8/2019 | Bendefy | E05F 1/1058 |

FOREIGN PATENT DOCUMENTS

| | | |
|---|---|---|
| DE | 20 2010 015 092 | 3/2012 |
| JP | 5821666 | 2/1983 |
| JP | 58-137769 | 9/1983 |
| JP | 58-137770 | 9/1983 |
| JP | 60-80275 | 6/1985 |
| JP | 3-5584 | 1/1991 |
| JP | 6-30376 | 4/1994 |
| JP | 2006-316501 | 11/2006 |
| JP | 2009-114734 | 5/2009 |
| JP | 2010-43457 | 2/2010 |
| JP | 2010-535955 | 11/2010 |
| JP | 2013-502517 | 1/2013 |
| WO | 2009/021799 | 2/2009 |
| WO | 2010/082028 | 7/2010 |
| WO | 2015/135005 | 9/2015 |
| WO | 2015/164894 | 11/2015 |

OTHER PUBLICATIONS

Search Report dated Nov. 23, 2016 in Austrian Application No. A 50145/2016, with English translation.

Salice Wind, Prospect [online], Arturo Salice S.p.A., Oct. 2005, Determined in the internet: <URL: http://www.thuressontrading.com/downloads/dl/file/id/386/product/0/salice_wind.pdf >.

* cited by examiner

ACTUATING ARM DRIVE

BACKGROUND OF THE INVENTION

The present invention relates to an actuating arm drive for at least one pivotably mounted actuating arm, a piece of furniture with such an actuating arm drive, and a method for producing such an actuating arm drive.

A number of actuating arm drives with levers connected to each other in an articulated manner are known in the state of the art. In order to be able to produce an actuating arm drive with a high-quality action, in particular without play, the individual parts, in particular the parts of the levers of the actuating arm drive, have to be manufactured with high precision and accuracy. Individual parts which can be manufactured for instance by die-cutting, and their connection to each other, can be pivotal for the quality of the assembled actuating arm drive, and a compromise often needs to be made between producible precision of the components and outlay in terms of time and manufacture. Complicated connections between individual levers of an actuating arm drive can additionally lead to an increased outlay on material and to an increased space requirement.

The object of the invention is to provide an actuating arm drive in which the above-named disadvantages do not occur.

SUMMARY OF THE INVENTION

This object is achieved by an actuating arm drive, a piece of furniture with at least one such actuating arm drive, and a method for producing such an actuating arm drive.

The object is achieved according to the invention in that at least one first and one second lever of the actuating arm drive are arranged in parallel with a lateral spacing from each other, and the levers each have two axle holes with a first standard spacing, through each of which an axle pin projects, and a third lever has receivers for the axle pins with a second standard spacing. The second standard spacing is bigger or smaller than the first standard spacing, and the axle pins each project through the axle holes of the first lever and of the second lever and are at least partially received in the receivers of the third lever. It can thereby be achieved that the assemblage created by axle pins and consisting of the first and second levers is stabilized by the addition of a third lever. A "first standard spacing" can mean here the desired spacing of the holes for receiving the axle pins in the first lever and in the second lever, and the actual spacing of the axle holes resulting during production of the levers can deviate from the standard spacing. An "axle pin" can mean a substantially pencil-shaped or cylindrical component, for example a steel pin, with a component diameter substantially corresponding to the diameter of the axle holes. The actual diameter of the axle pin as well as of the axle holes here can deviate slightly from the desired diameters in each case during production. Because the axle pins respectively passing through the axle holes of the first lever and of the second lever and also at least partially into the receivers of the third lever, which have a second standard spacing deviating from the first standard spacing, any deviations occurring during production can be compensated for. The axle pins here can be braced in the receivers and axle holes in such a way that a play-free assemblage of the first and second levers by the third lever can result.

It can be advantageous here that the first and second levers are formed substantially flat. A flat formation of the levers can be produced simply in terms of process engineering, for example by die-cutting, and also makes it easier to install the axle holes, which can also be produced in a die-cutting method. A flat formation of the levers with axle pins running substantially transversely (normal) to the surfaces, for connecting the levers, can additionally have advantageously high flexural strength.

It can also be advantageous here that the first and second levers are formed identical. This can make it possible that, during the production of the actuating arm drive and in particular of the levers, there need be no distinction between the components corresponding to the first and second levers, and the tools necessary for their production and processing.

It can be further advantageous that the third lever is formed substantially flat. On the one hand, a compact assemblage of the first, second, and third levers can be made possible thereby. On the other hand, a flat formation of the third lever can prove to be advantageous, in particular in the case of an elastically resilient deformation of the third lever to at least partially receive the axle pins.

It can be advantageous that the third lever is formed elastically resilient. The third lever can thereby be deformed to at least partially receive the axle pins respectively passing through the axle holes of the first lever and of the second lever. A spring force thereby exerted on the axle pins can advantageously result in a play-free bracing of the assemblage of the levers.

It can be further advantageous that the third lever has a substantially curved, preferably wavy, shape. An elastically resilient deformability of the lever can thereby be made easier.

It can be advantageous here if the third lever has a spring constant in a range of from 50 to 250 N/mm, preferably in a range of from 100 to 150 N/mm (Newtons per millimetre). In other words, it can be advantageous if the third lever applies a spring force of from 50 to 250 Newtons, preferably a spring force of from 100 to 150 Newtons, in the case of a deformation, thus in the case of a change in the spacing of the receivers of the axle pins in the case of elastic deformation, by 1 mm. A spring constant in such a range represents a good compromise between simple assembly and compensation for play on the one hand and easy movability during operation of the actuating arm drive on the other hand.

It can also be advantageous that the receivers of the axle pins in the third lever are formed in the form of an axle hole and/or as an indentation. Forming at least one receiver of the third lever in the form of an axle hole can ensure a secure and undetachable connection to the other levers and to an axle pin passing through axle holes thereof. A pivotable mounting of the third lever on an axle pin can also be made possible thereby. The formation of at least one of the receivers of the third lever in the form of an indentation no detachable connection of the third lever to one of the axle pins be made possible. An "indentation" can mean here a recess out of the third lever suitable for at least partially receiving an axle pin. Such an indentation can be advantageous in particular if the third lever is to be effected after the connection of the first lever to the second lever by means of the axle pins has already been effected. For example, a third lever provided with an axle hole and an indentation can here be mounted with the axle hole pivotably on one of the axle pins and can be pivoted or clipped onto the second axle pin with the indentation.

It can also be advantageous that the third lever is arranged—preferably substantially completely—between the first lever and the second lever. Through an arrangement of the third lever between the other levers, it can be at least partially masked. In particular, in the case of an elastically resilient bracing of the third lever between the axle pins, a substantially symmetrical exertion of force on the first lever and on the second lever can result here.

It can be further advantageous that the lateral spacing of the first lever from the second lever substantially corresponds to the thickness of the third lever. A particularly compact and stable assemblage of the levers can thereby be achieved.

It can be advantageous that the deviation of the second standard spacing from the first standard spacing is in a range of from 1% to 10%, preferably in a range of from 5% to 10%. On the one hand, a sufficiently great tolerance compensation of the axle pins mounted in the axle holes results, and on the other hand, it is also possible to prevent frictional forces that have a negative effect on the operation of the actuating arm drive from occurring in the case of a pivotable mounting of the axle pins in the axle holes.

It can be advantageous that the deviation of the second standard spacing from the first standard spacing is in a range of from 0.1 mm to 5 mm, preferably in a range of from 0.1 mm to 1 mm. On the one hand, a deviation in this range can ensure that the desired second standard spacing can be produced within the manufacturing tolerances and, on the other hand, a deviation in this range can ensure an effective tolerance compensation.

In principle, it can be advantageous that the second standard spacing is greater than the first standard spacing. The spacing of the receivers of the third lever for receiving the axle pins passing through the axle holes of the first lever and of the second lever can here be reduced by compression substantially to the first standard spacing—for example by elastic deformation of the third lever—and thus a spreading-apart of the two axle pins results. The deviation of the second standard spacing from the first standard spacing here is preferably chosen in such a way that the load on the axle pins of the levers is made the same by the third lever, such as the load on the axle pins by the weight of a flap installed on the actuating arm drive in an installed position of the actuating arm drive.

It can be advantageous if the ratio of the height of the third lever to the second standard spacing of the third lever is 0.35 or less, preferably 0.25 or less, particularly preferably 0.15 or less. The third lever can preferably have such a ratio between the height and the spacing of the receivers at least in sections. The "height of the third lever" can mean here an extent of the third lever running substantially transversely, at least in sections, to the connecting line of the receivers of the axle pins (second standard spacing).

Protection is also sought for a piece of furniture with at least one actuating arm drive as described above.

Protection is also sought for a method for producing an actuating arm drive as described above. In such a method, the third lever is pre-tensioned by stretching or compression to the first standard spacing when the actuating arm drive is assembled, and retains this pretension in the installed state. The third lever here can have, for example, a receiver in the form of an axle hole and a further receiver in the form of an indentation. In a production method here, the third lever can be arranged between the first lever and the second lever in one method step. In a further method step, the levers can be provided with an axle pin through the respective axle holes, in a further method step the first and second levers can be provided with a further axle pin, and in a last method step, the third lever, now mounted pivotably on one of the axle pins, can be pivoted or clipped onto the further axle pins, with the result that the third lever is pre-tensioned by stretching or compression to the first standard spacing and retains this pretension in the installed state.

In other words, in such a method for producing an actuating arm drive as described above, the receivers for the axle pins in the third lever are formed in the form of an axle hole and an indentation. In a first method step, the third lever is arranged between the first lever and the second lever, in a second method step, a first axle pin is introduced into a first axle hole of the first lever, a first axle hole of the second lever, and the one axle hole of the third lever, in a third method step, a second axle pin is introduced into a second axle hole of the first lever and a second axle hole of the second lever, and in a fourth method step the third lever is pivoted onto the second axle pin by a pivoting movement. The axle pin is introduced into the indentation of the third lever by the pivoting. The axle pins here are introduced in each case axially into the receivers of the levers formed in the form of axle holes. The receiver for the axle pins in the form of an indentation differs from the receivers in the form of axle holes in that an axle pin can also be introduced radially into the indentation, for example by a pivoting movement of the corresponding lever.

BRIEF DESCRIPTION OF THE DRAWINGS

Further details and advantages of the present invention are explained in more detail below with the aid of the description of the figures with reference to the examples represented in the drawings, in which.

DETAILED DESCRIPTION OF THE INVENTION

Figure 1A:
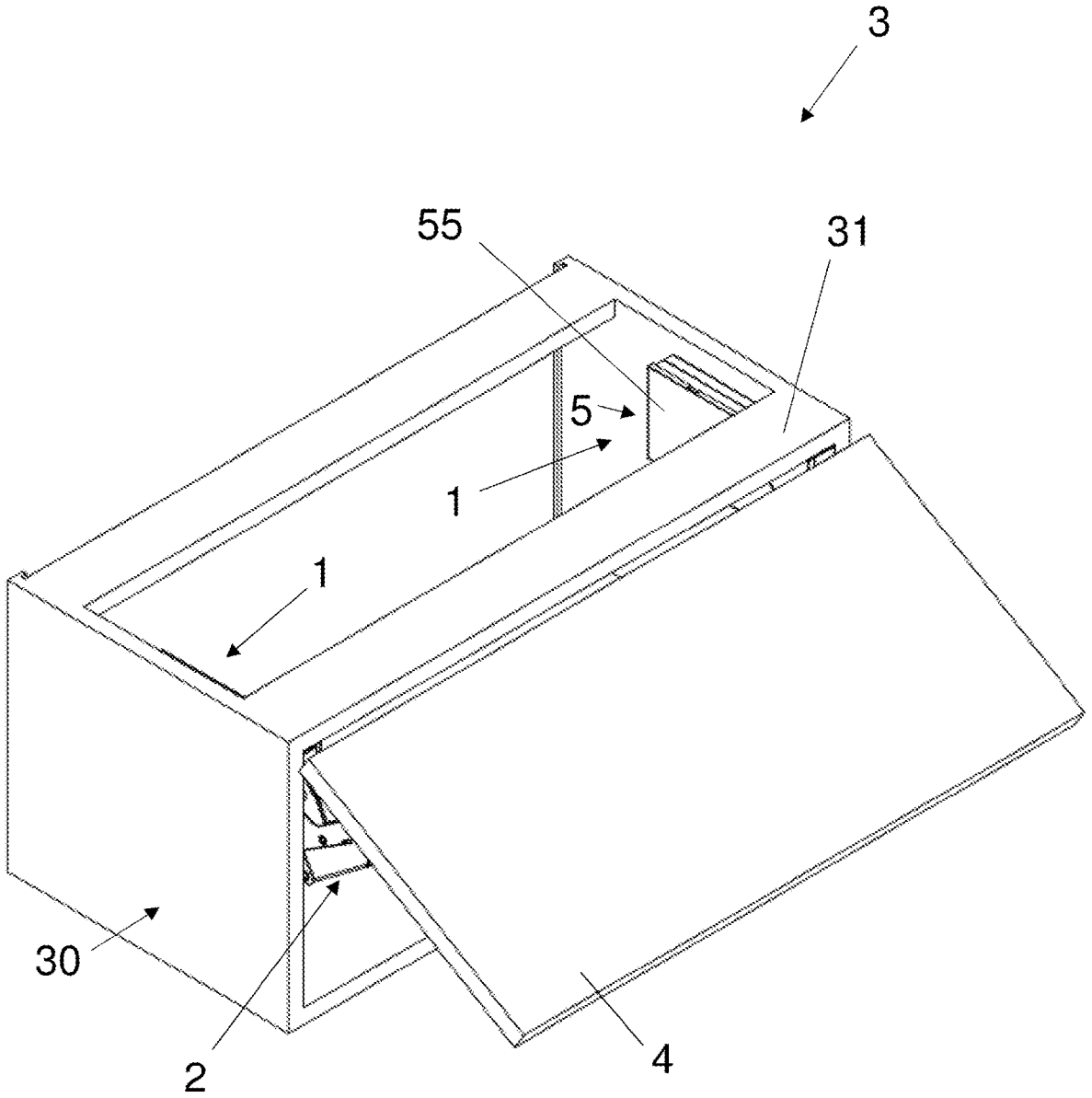
FIG. 1*a* is a perspective view of a piece of furniture.

FIG. 1*a* shows a piece of furniture 3 with a furniture carcass 30, in the interior of which two actuating arm drives 1 are installed under a carcass top 31. A movable flap 4 is secured to the actuating arms 2 of the actuating arm drives 1 and is thus mounted pivotably on the furniture carcass 30 by the actuating arm drives 1. The actuating arm drive 1 is secured to the furniture carcass 30 via a housing 5 provided with a housing cover 55.

Figure 1B:
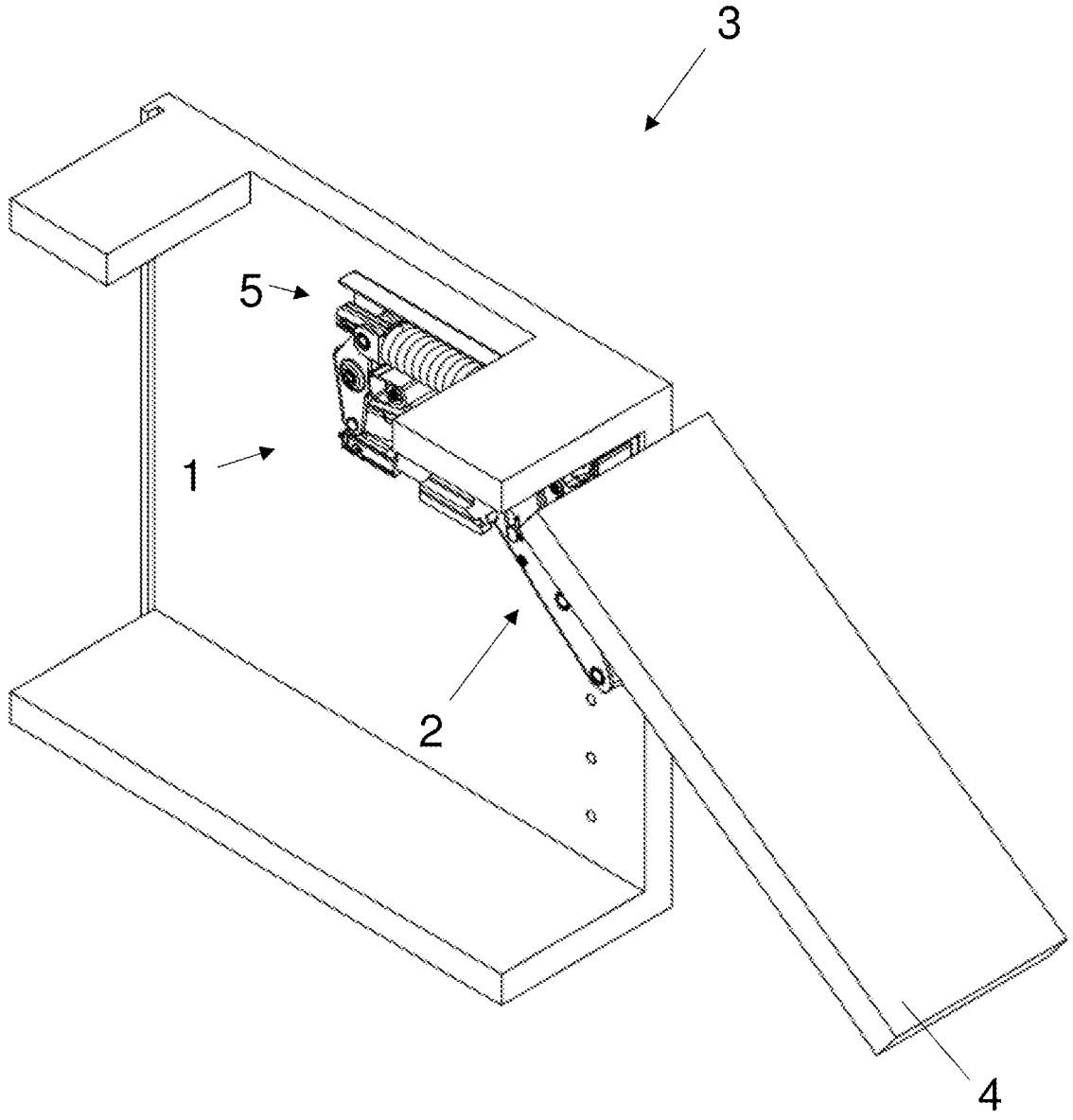
FIG. 1*b* is a perspective sectional representation of a piece of furniture.

FIG. 1*b* shows a perspective view of a sectional representation of the piece of furniture 3 shown in FIG. 1*a*, wherein the actuating arm drive 1 is shown without the housing cover 55 of the housing 5. As above, a flap 4 is secured to the actuating arm 2 of the actuating arm drive 1.

Figure 2A:
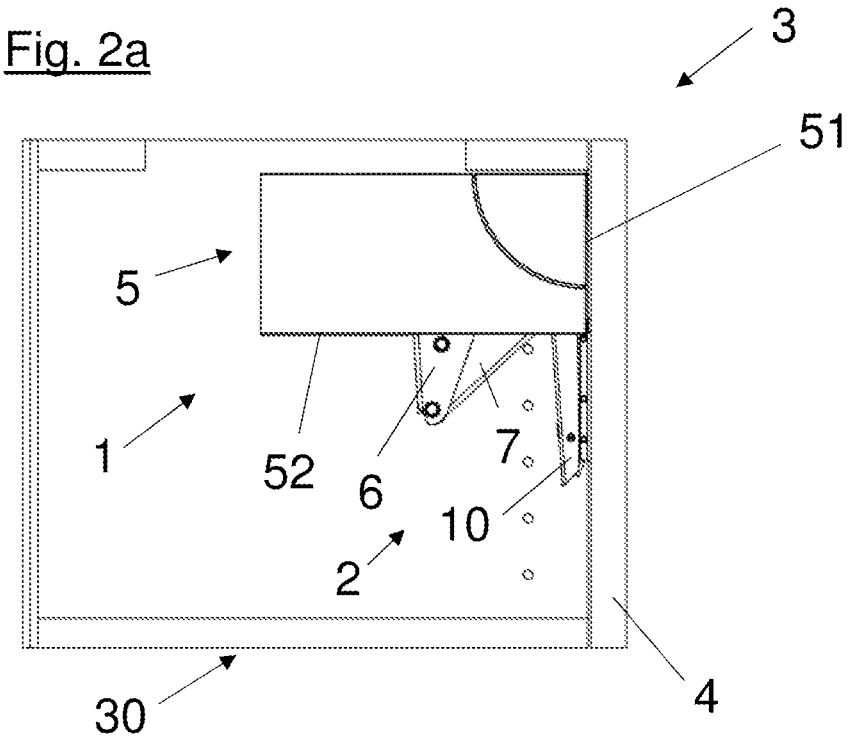
FIGS. 2*a* to 2*d* are side views of a sectional representation of a piece of furniture with different positions of the actuating arm drive.

FIGS. 2*a* to 2*d* show the progression of an opening movement—or, with the sequence reversed, the progression of a closing movement—of a piece of furniture 3 with a pivotably mounted flap 4. Here, the closed position of the actuating arm drive 1, in which the furniture carcass 30 is closed by the flap 4, is shown in FIG. 2*a*. As shown in the embodiment of FIG. 2*a*, the actuating arm drive 1 has a pivotably mounted actuating arm 2 with several levers connected to each other in an articulated manner. Parts of the main lever 6 are mounted pivotably on the housing 5, parts of the intermediate lever 7 are mounted pivotably on the main lever 6, and a part of the supporting lever 10 is formed to secure the flap 4. In the closed position of the actuating arm drive 1 shown, the main lever 6 and the intermediate lever 7, connected thereto in an articulated manner, and the supporting lever 10 protrude from a long side 52 of the housing 5. In the closed position of the embodiment shown, the front side 51, facing the inner side of the flap 4, of the housing 5 of the actuating arm drive 1 is free of protruding levers of the actuating arm 2 and closes substantially flush with the furniture carcass 30.

Figure 2B:
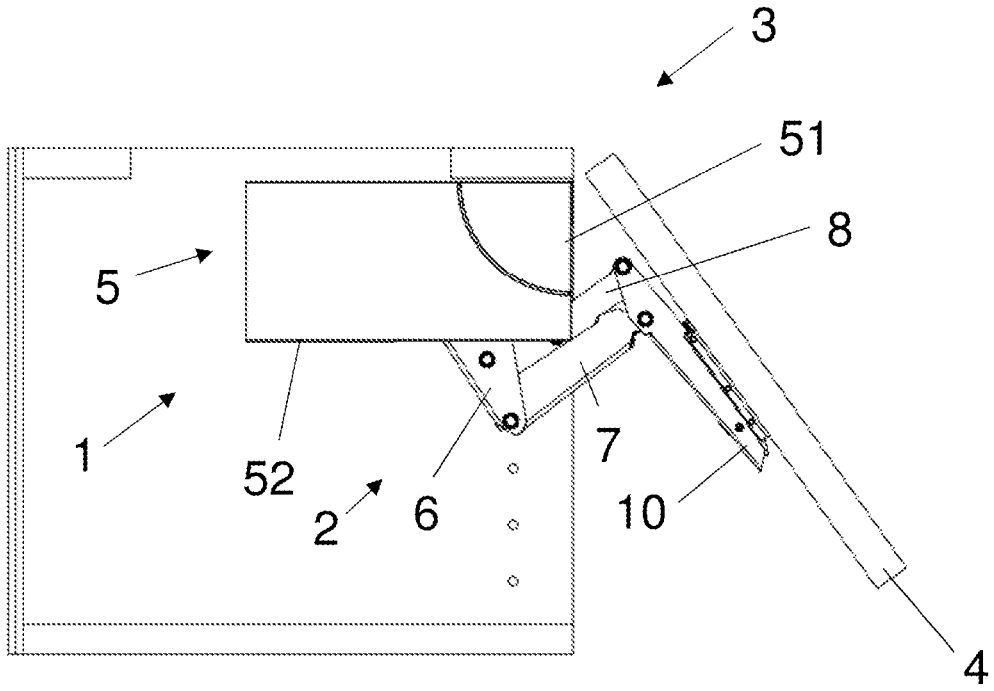

FIG. 2*b* shows a piece of furniture 3 with a partially opened flap 4. The actuating arm 2 of the actuating arm drive 1 supporting the flap 4 is partially pivoted out of the closed position here. In this position of the actuating arm 2 pivoted in the direction of the open position, the levers of the actuating arm 2 connected to each other in an articulated manner protrude partially from the long side 52 of the housing 5 and partially from the front side 51 of the housing 5. In addition to the main lever 6, the intermediate levers 7, 8 arranged nested in each other as well as the supporting lever 10 mounted pivotably thereon are visible here.

Figure 2C:
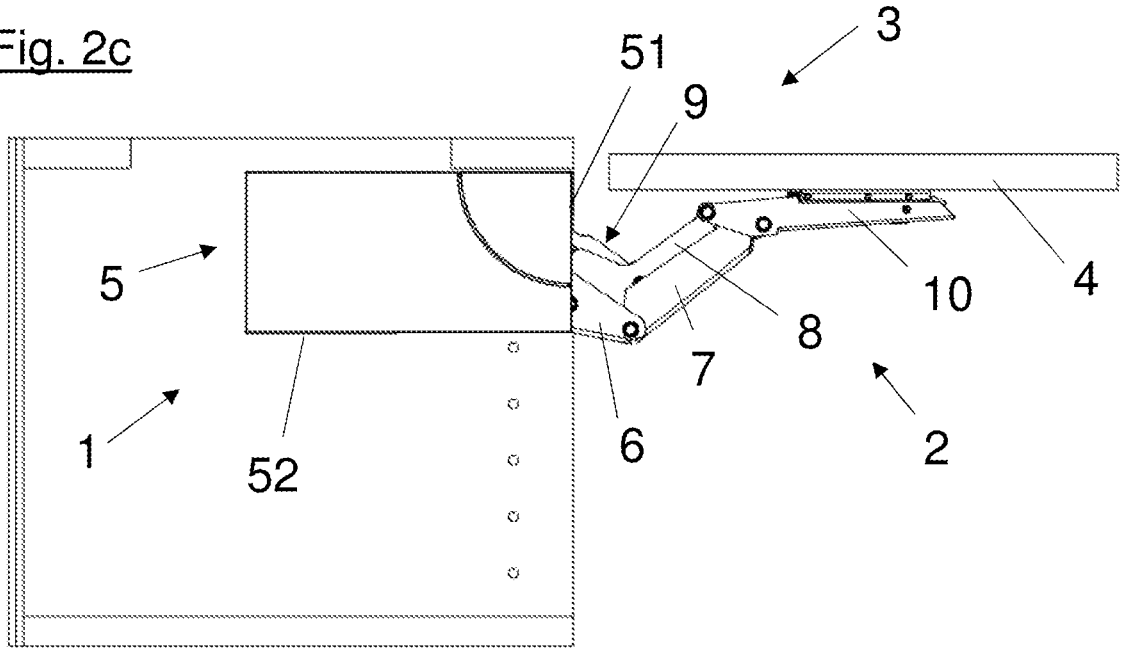

FIG. 2*c* shows a piece of furniture 3 with a furniture flap 4 pivoted further in the direction of the open position. Here, the actuating arm 2 supporting the flap 4 is pivoted further in the direction of the open position, with the result that now, in addition to the main lever 6 and the intermediate levers 7, 8 arranged nested in each other and the supporting lever 10, the guide lever 9 mounted pivotably on the housing 5 is also to be seen. As shown, a nested seven-joint linkage is formed by the levers. In this pivot position of the actuating arm 2, the long side 52 of the housing 5 is already free of protruding levers, whereby it can be made much easier for a user to access the interior of the piece of furniture 3. The levers forming the actuating arm 2 therefore protrude from the front side 51 of the housing 5 only in this pivot position of the actuating arm drive 1 close to the open position.

Figure 2D:
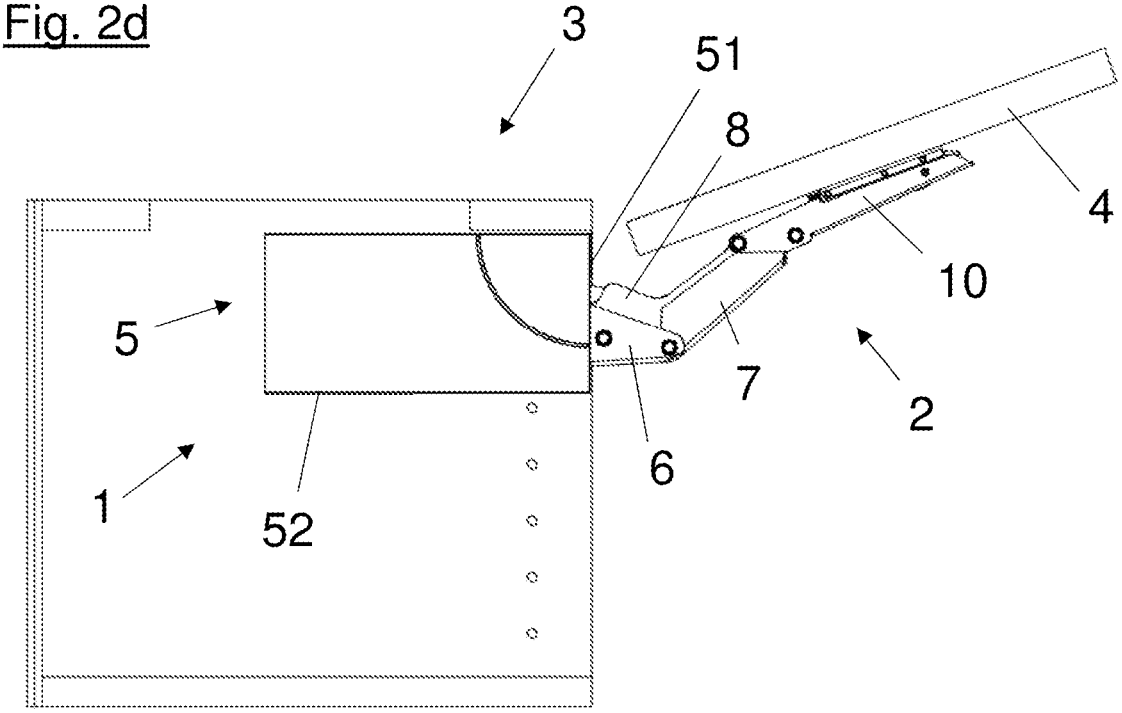

A piece of furniture 3 with a completely opened flap 4 is shown in FIG. 2*d*. The actuating arm 2 of the actuating arm drive 1 here is in the open position, in which the levers forming the actuating arm 2 protrude from the front side 51 of the housing 5. In contrast to the closed position of the actuating arm drive 1, in the open position of the actuating arm drive 1, the long side 52 of the housing 5 directly adjoining the front side 51 is free of protruding levers.

Figure 3:
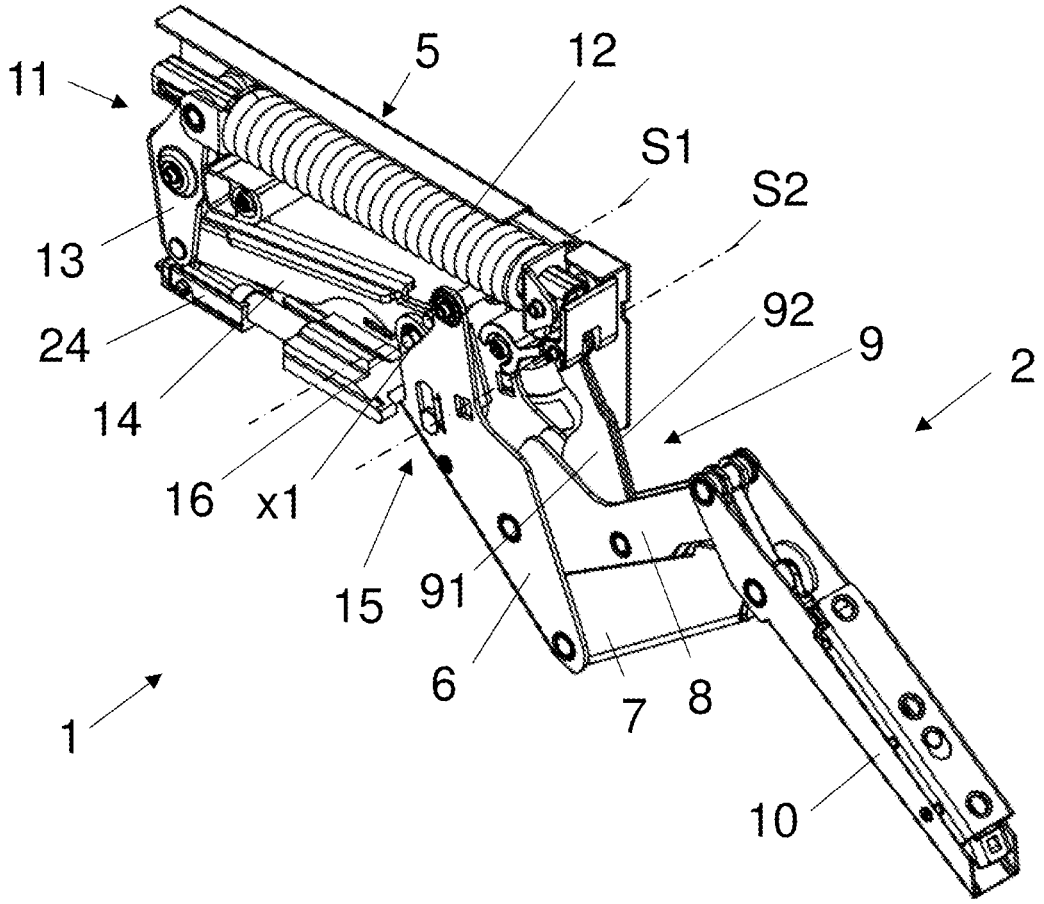
FIG. 3 is a perspective view of an actuating arm drive.

FIG. 3 shows a perspective view of an actuating arm drive 1 with housing cover removed. The alignment of the actuating arm drive 1 here substantially corresponds to the installed position in a piece of furniture 3 shown in the preceding figures. The housing 5 of the actuating arm drive 1 accommodates an energy storage mechanism 11 with a spring 12 installed lying down, running substantially horizontally, a bell crank 13 connected thereto in an articulated manner and mounted pivotably on the housing 5, and a transfer lever 14 connected pivotably to the bell crank 13. The actuating arm drive 1 also has a damping device 24 for damping the pivoting movement of the actuating arm 2 during a closing movement. In the embodiment of the actuating arm drive 1 shown in FIG. 3, the actuating arm 2 is formed of a main lever 6 mounted on the housing 5 pivotably about a first pivot axis S1, two intermediate levers 7, 8 mounted pivotably on the main lever 6, a guide lever 9 mounted pivotably on the second intermediate lever 8 and, about a second pivot axis S2, on the housing 5, and a supporting lever 10 mounted pivotably on the intermediate levers 7, 8. The guide lever 9 is formed of a first lever 91 and a second lever 92 connected thereto, as well as a third lever 93, not visible here. The main lever 6 and the first intermediate lever 7 have a profiled cross section, substantially corresponding to a U-shaped profile, and are arranged nested in each other. In addition, the first intermediate lever 7 and the second intermediate lever 8 are arranged nested in each other, as is also true of the second intermediate lever 8 and the guide lever 9. Overall a particularly stable design of the actuating arm 2 with a particularly small space requirement can be achieved by the nested arrangement of the main lever 6, the intermediate levers 7, 8 and the guide lever 9. The main arm 6 is loaded with a force by the energy storage mechanism 11 via a force-transmission element 16. Here, the force-transmission element 16 is connected pivotably to the transfer lever 14 of the energy storage mechanism 11 and pivotably to the setting device 15 attached to the main lever 6. The force-transmission point x1 of the force-transmission element 16 is positioned on the main lever below the pivot axis S1, whereby a torque is effectively exerted on the main lever 6 by the energy storage mechanism 11, with the result that the actuating arm 2 is pivoted in the direction of the open position without external influence.

Figure 4A:
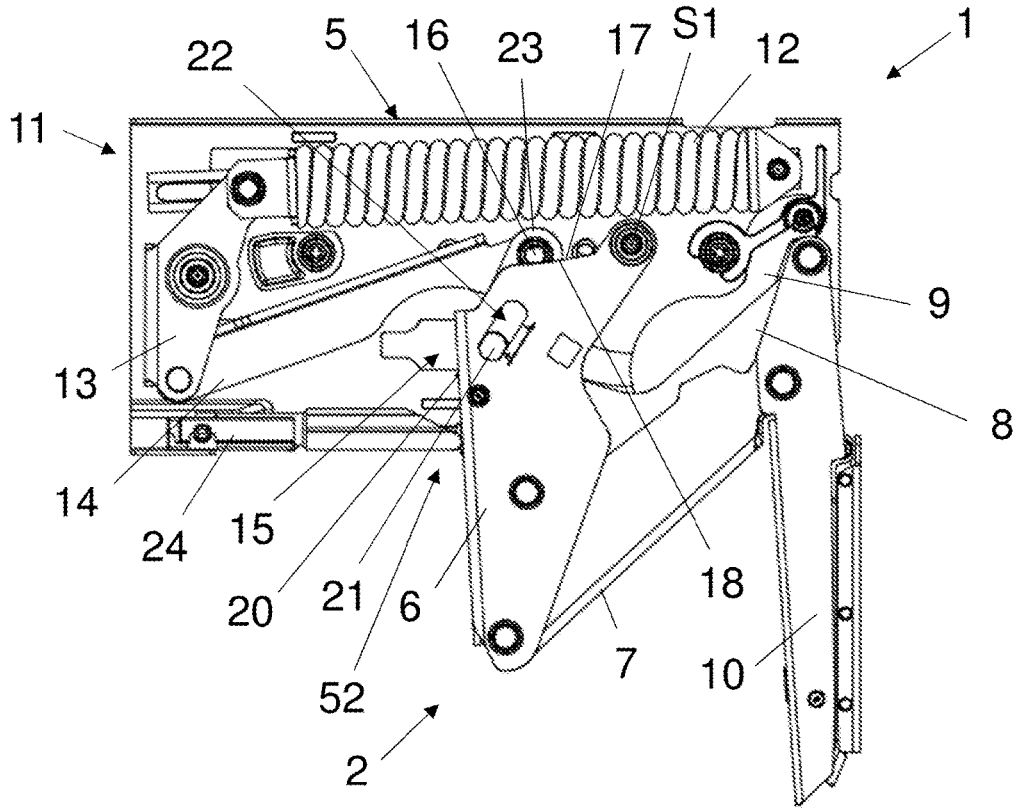
FIGS. 4*a* to 4*c* are side views of an actuating arm drive in different pivot positions.

FIG. 4*a* shows a side view of an actuating arm drive 1 with housing cover removed. As shown, the actuating arm 2 of the actuating arm drive 1 is in the closed position, wherein here the force originating from the energy storage mechanism 11 acts on the main lever 6 of the actuating arm 2 via the transfer lever 14 in such a way that it is actively pushed into the closed position. Thus, the line of action of the force originating from the energy storage mechanism 11 runs along the transfer lever 14 in relation to the pivot axis S1 of the main lever 6 (above the pivot axis S1) in such a way that the main lever 6 is actively pivoted into the closed position via the force-transmission element 16 connected to the main arm 6 by the setting device 15 and is held there. The setting device 15 is in the form of a threaded spindle 20 mounted rotatably on the main arm 6 (for this, see also FIG. 5*a*), a sliding block 21 mounted displaceably in the threaded spindle 20 and a guideway 22 formed substantially in a straight line in the main arm 6, and a connecting piece 23 connected in an articulated manner to the sliding block 21 and the force-transmission element 16. The threaded spindle 20, the sliding block 21 and the connecting piece 23 here are at least partially arranged in the inner region of the main lever 6 formed profiled. For the bearing of the force-transmission element 16, a bearing contour 17 is formed on end faces 18 of the main lever 6, wherein the setting device 15 is formed to adjust the force-transmission element 16 along the bearing contour 17.

Figure 4B:
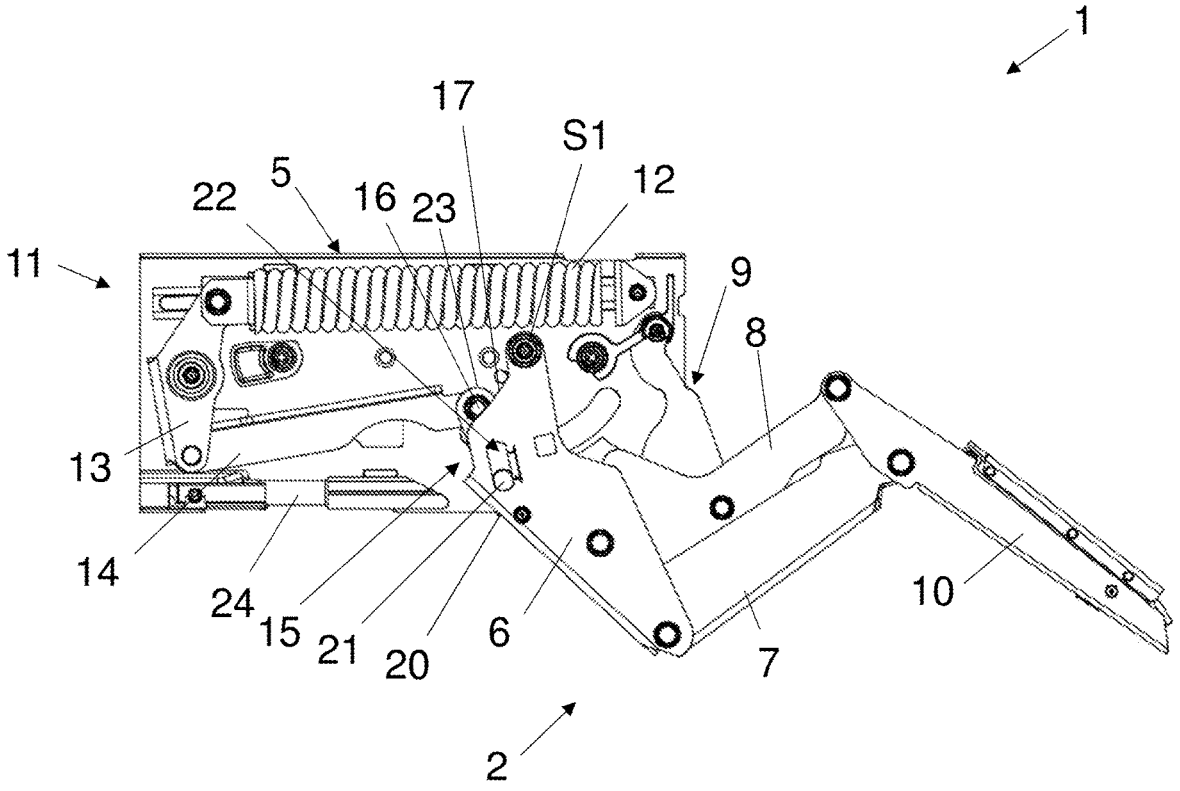
Figure 4C:
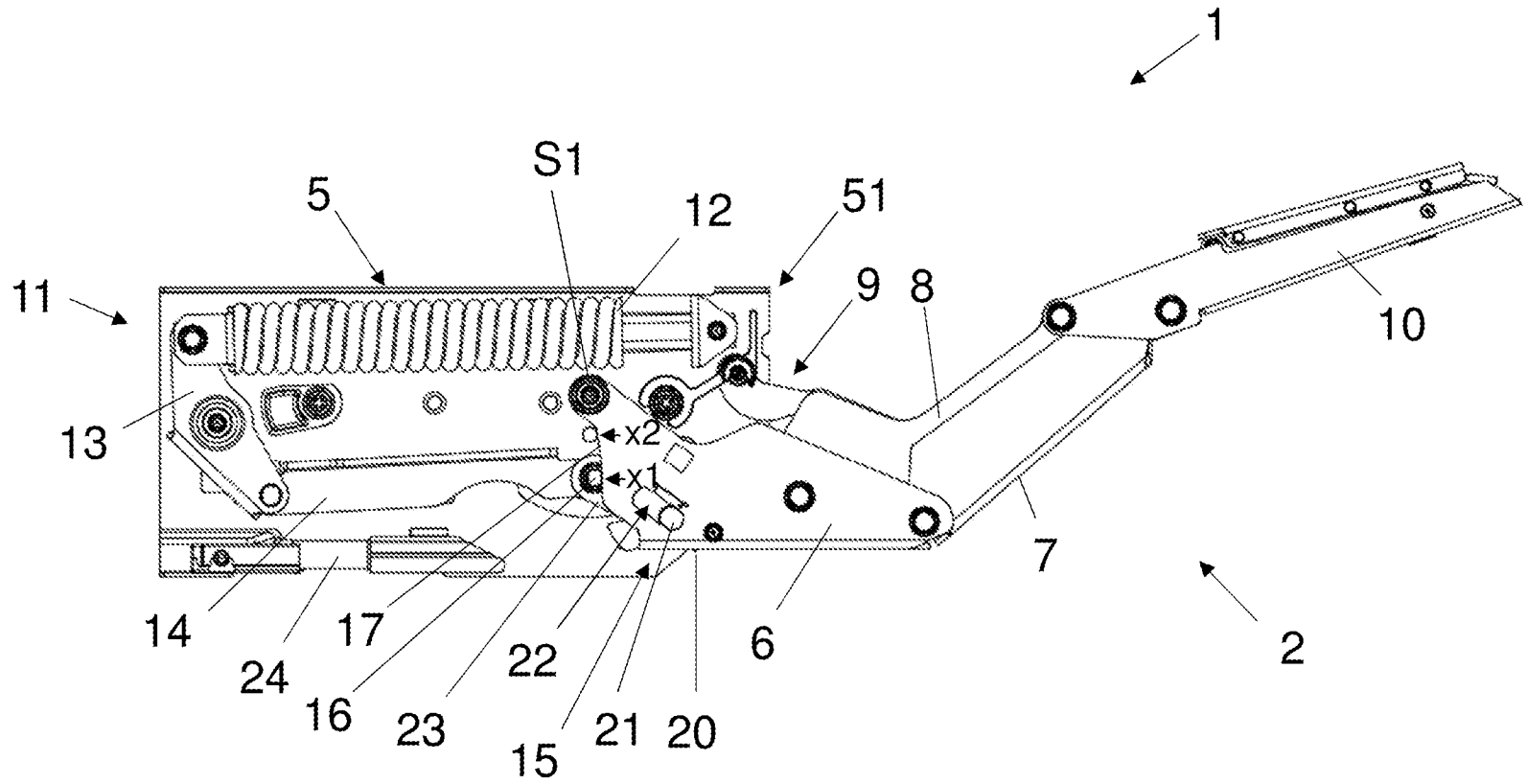
Figure 7A:
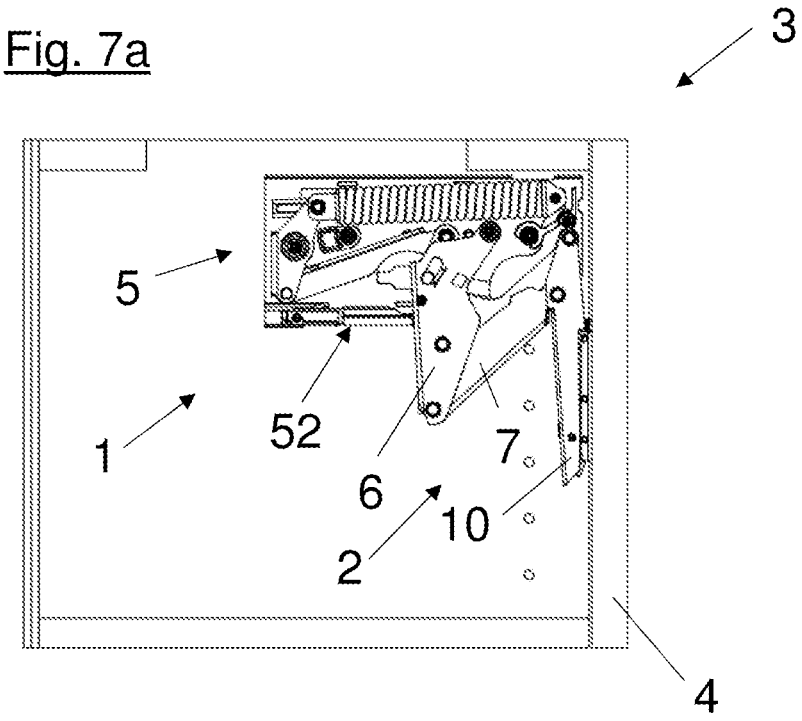
FIGS. 7*a* to 7*d* are side views of a sectional representation of a piece of furniture.
Figure 7B:
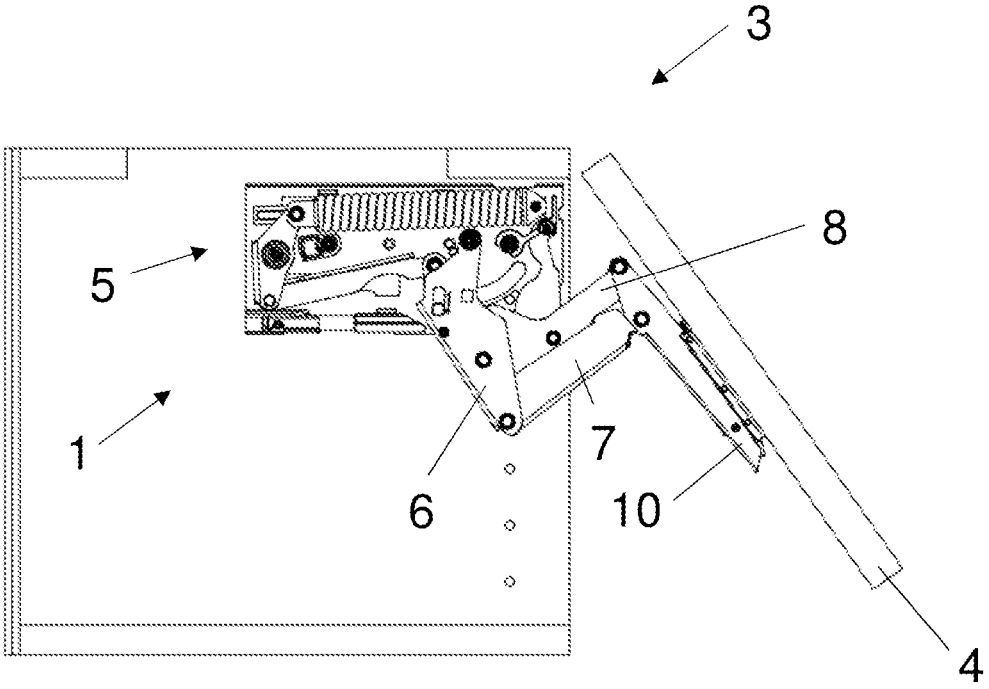
Figure 7C:
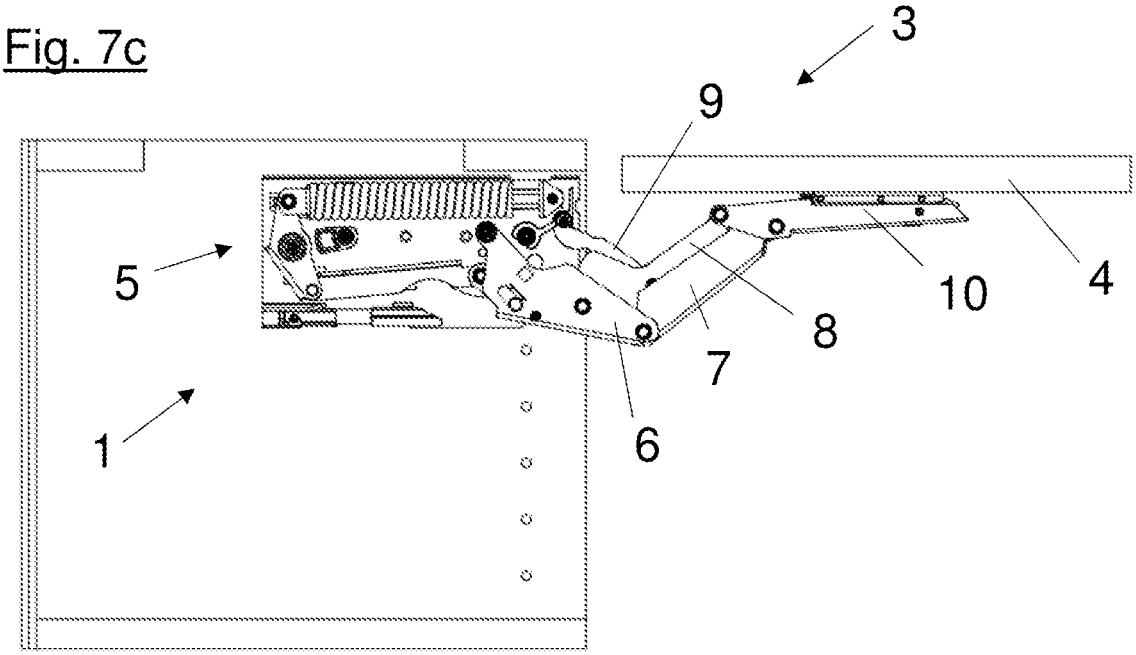
Figure 7D:
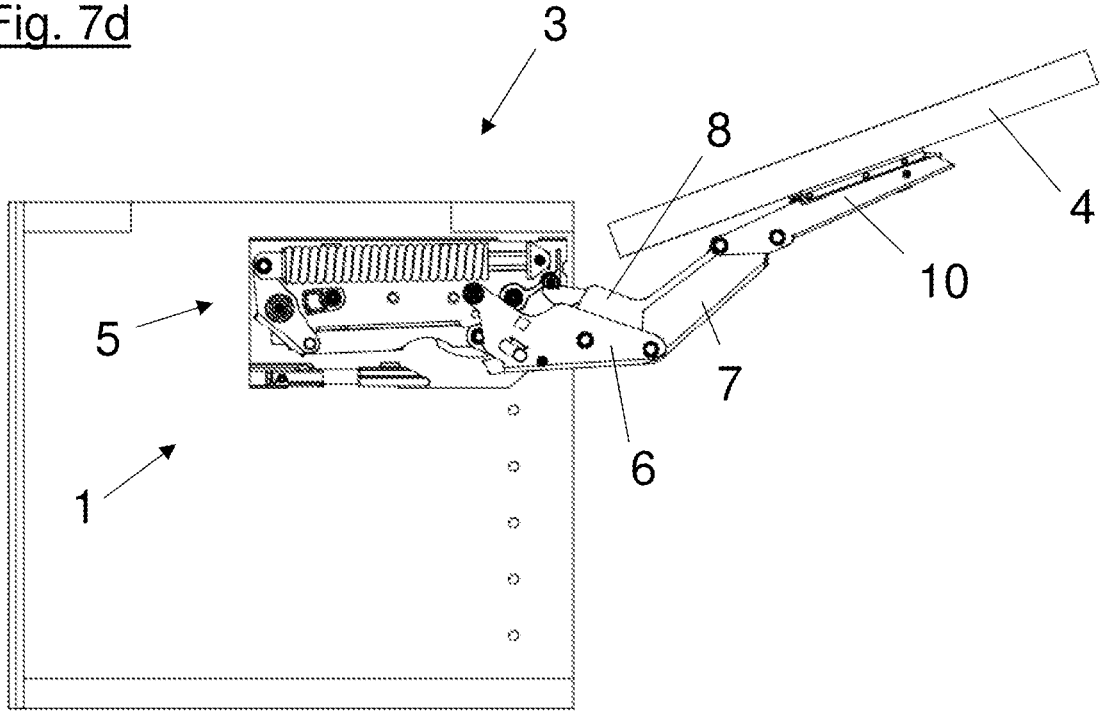

An actuating arm drive 1 with an actuating arm 2 partially pivoted out of the closed position is shown in FIG. 4*b*. Here, by comparison with FIG. 4*a*, the nested structure of the levers of the actuating arm 2 forming a seven-joint linkage is recognizable. In this pivot position of the actuating arm 2 the line of action of the force acting on the main arm 6 running along the transfer lever 14 of the energy storage mechanism 11 runs in relation to the pivot axis S1 of the main lever 6 (below the pivot axis S1) in such a way that the actuating arm 2 is pushed further in the direction of the open position. The substantially gap-free overlap between the two intermediate levers 7, 8 in a lateral direction relative to the pivoting movement of the actuating arm 2 is also clearly recognizable. An actuating arm drive 1 with an actuating arm 2 in the open position is shown in FIG. 4*c*. Here, the levers forming the actuating arm 2 protrude from the front side 51 of the housing 5 of the actuating arm drive 1. As shown, the setting device is in a setting in which the force-transmission element 16 is positioned on the bearing contour 17 at a first force-transmission point x1. In this setting, the spacing (radially) between the pivot axis S1 of the main lever 6 and the first force-transmission point x1 is at its maximum size, whereby a large force acts on the actuating arm 2 from the energy storage mechanism 11. A further setting of the setting device 15, in which the stylistically indicated force-transmission element is positioned at the second force-transmission point x2, is positioned further in the direction of the pivot axis S1 (for this, see also FIG. 9*b*). In the open position of the actuating arm drive an adjustment of the force-transmission point of the force-transmission element 16 on the bearing contour 17 of the main lever 6 is effected substantially transversely to the line of action of the force running along the transfer lever 14. In the case of a use, as shown in FIG. 7*d*, of the actuating arm drive 1 with a piece of furniture 3 with a flap 4 driven by the actuating arm drive 1, this has the advantage that one setting of the setting device 15 corresponds directly to the force acting on the flap 4 (compensation for the force on the actuating arm 2 exerted by the weight of the flap 4).

Figure 5A:
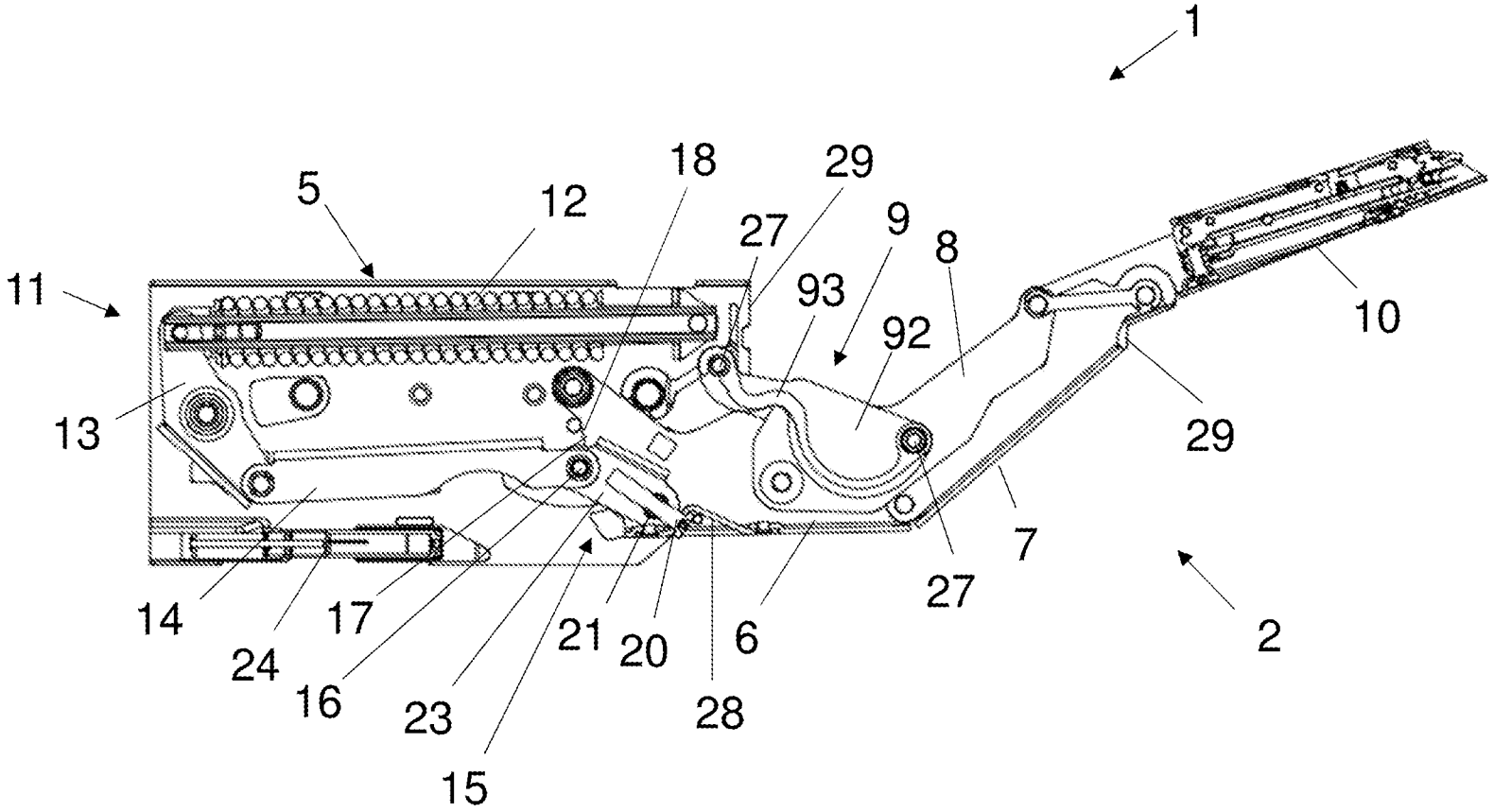
FIG. 5*b* is a detail view of the actuating arm drive shown in FIG. 5*a*.

FIG. 5*a* shows a side view of a sectional representation of an actuating arm drive 1 in a pivot position of the actuating arm 2 as shown in FIG. 4*c*. Here, in addition to the energy storage mechanism 11 accommodated in the housing 5, the main lever 6 is shown with the positioning contour 17 formed on one of the end faces 18. The individual parts of the setting device 15 are likewise shown in this sectional representation. Specifically these are the threaded spindle 20 mounted rotatably on a bearing point 28 formed in the main arm 6 and the sliding block 21 mounted therein, as well as the connecting piece 23 connected pivotably to the sliding block 21 and the force-transmission element 16. During a rotation of the threaded spindle 20 the non-rotatably mounted sliding block 21 can be displaced along the spindle in the guideway 22, not visible here, of the main lever 6, wherein here the connecting piece 23 connected pivotably to the sliding block 21, as well as the force-transmission element 16, is also displaced and—loaded with force by the transfer lever 14 of the energy storage mechanism 11—the force-transmission element 16 thereby comes to rest at another point on the bearing contour 17.

In order to guarantee an effective screening and anti-trap protection in every pivot position of the actuating arm 2, cover plates 29 can be provided which automatically cover openings in the housing 5 or in the actuating arm 2 resulting during pivoting.

The second lever 92 of the guide lever 9 and the third lever 93 introduced between the axle pins 27 of the guide lever 9 and serving for tolerance compensation are further shown in FIG. 5*a*. This is now to be discussed further in the following.

Figure 5B:
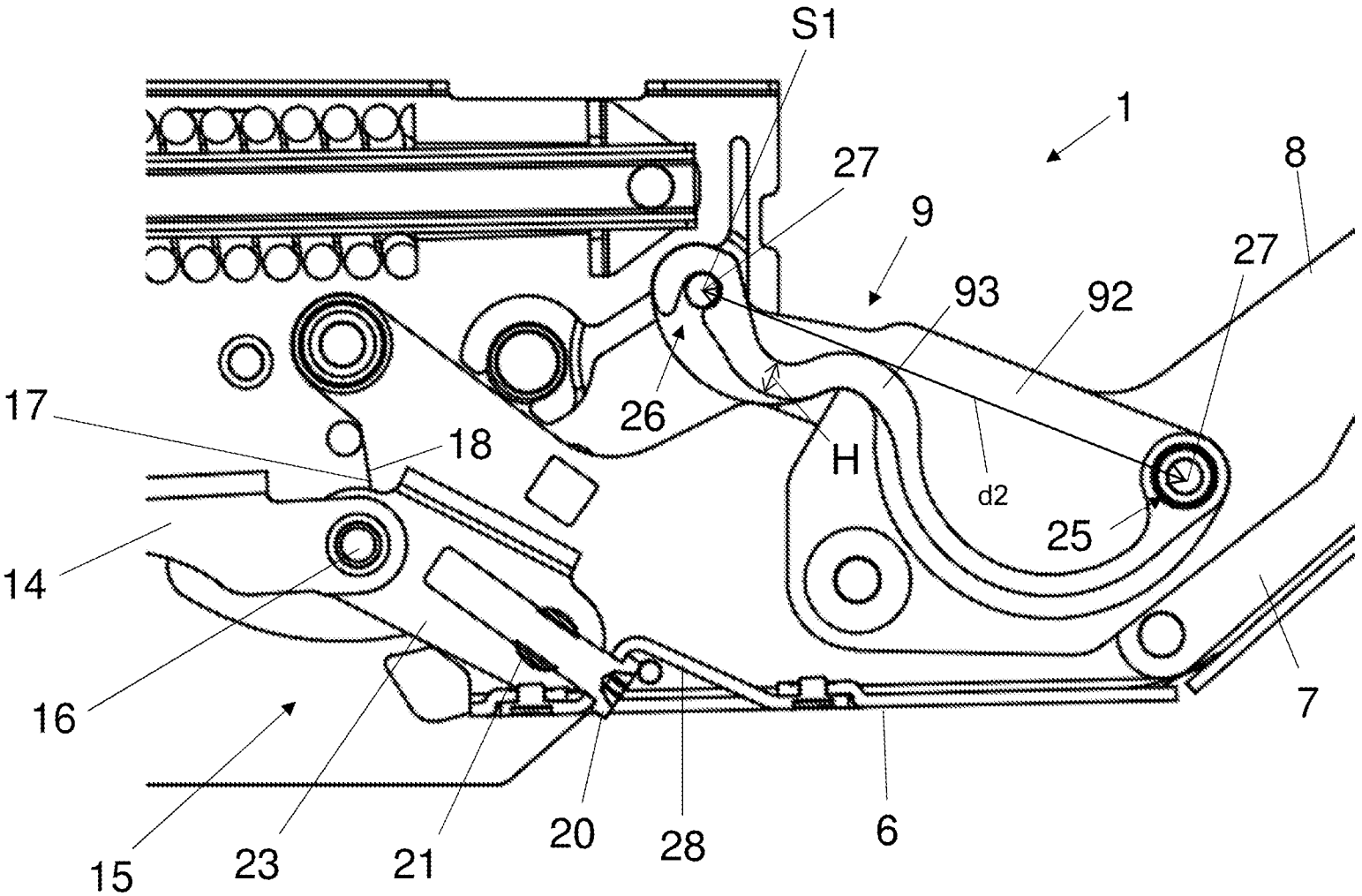

FIG. 5*b* shows a detail view of the sectional representation of the actuating arm drive 1 shown in FIG. 5*a*. In particular, the parts of the setting device 15 and two of the levers of the guide lever 9 are shown here. Thus, the second lever 92 of the guide lever 9 is shown with the housing-side (first) axle pin 27 forming the pivot axis S1 and the second axle pin 27 serving for the pivotable mounting of the second intermediate lever 8. At a first end the third lever 93, having a wavy shape, is an axle hole 25, with which the third lever 93 is received on the second axle pin 27. At the second end the third lever 93 in this embodiment is an indentation (recess) 26, by which the third lever 93 is pivoted or clipped onto the first axle pin 27 forming the pivot axis S1. The first and second axle pins 27 are spread apart by the elastically resiliently deformed third lever 93 in such a way that any radial play of the axle pins 27 existing because of manufacturing tolerances can be compensated for in the bearing points of the housing 5 or the levers.

The third lever 93 has a height H at least in certain sections, and the axle hole (receiver) 25 and the indentation (receiver) 26 of the third lever 93 have the second standard spacing d2.

Figure 6:
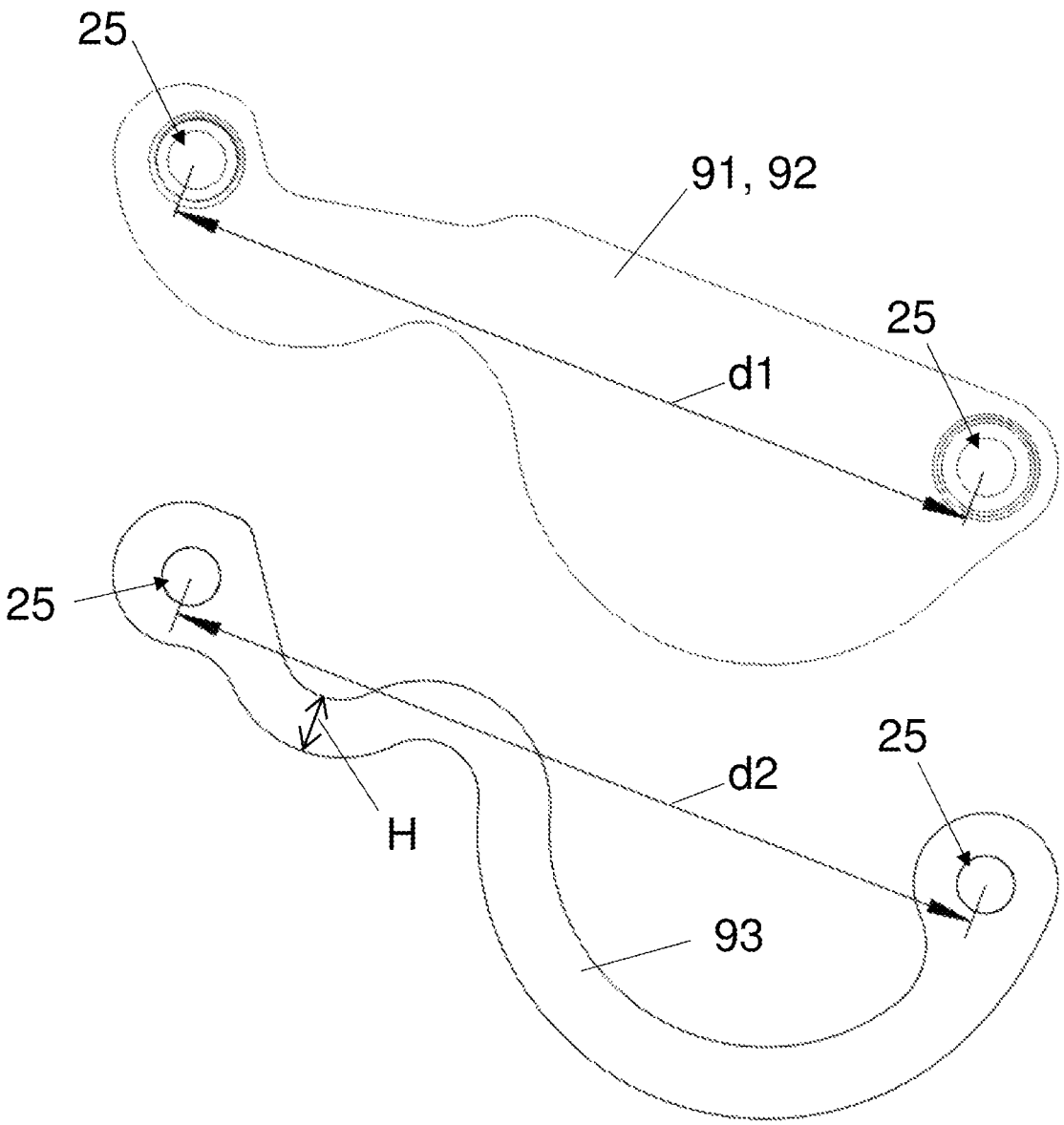
FIG. 6 is a side view of two levers of an actuating arm drive.

The first lever 91 and the third lever 93 of another embodiment are represented in FIG. 6. The representation of the first lever 91 here can also correspond to the representation of the second lever 92, if they are formed identically in terms of their shape. The first lever 91 here has two axle holes (receivers) 25, the centers of which have a first standard spacing d1. In other words, the centers of the two axle holes 25 of the first lever 91 are spaced apart by a distance d1. In order to be able to guarantee a pivotable mounting of the first lever 91 (and also of the second lever 92), the axle holes 25 can have a slightly larger hole diameter than the axle pins 27 (not shown here) which are to be received in the axle holes. In this embodiment, the third lever 93 having a curved, wavy shape likewise has two axle holes (receivers) 25. The centers of the axle holes 25 of the third lever 93, however, have a second standard spacing d2 deviating (different) from the first standard spacing d1 in a relaxed (non-tensioned and uninstalled) state of the third lever 93. If the guide lever 9 is composed of the first lever 91, the second lever 92, and the third lever 93, preferably arranged between the first lever 91 and the second lever 92, the third lever 93 can be pre-tensioned by stretching or compression to the first standard spacing d1, with the result that it retains its pre-tension in the installed state. A stabilization of the guide lever 9 composed of the individual levers can thereby result.

Analogously to FIGS. 2*a* to 2*d*, a process of opening or, with the sequence reversed, a process of closing a piece of furniture 3 with a flap 4 driven by an actuating arm drive 1 is shown in FIGS. 7*a* to 7*d*, wherein the actuating arm drive 1 is represented without the housing cover 55.

Figure 8A:
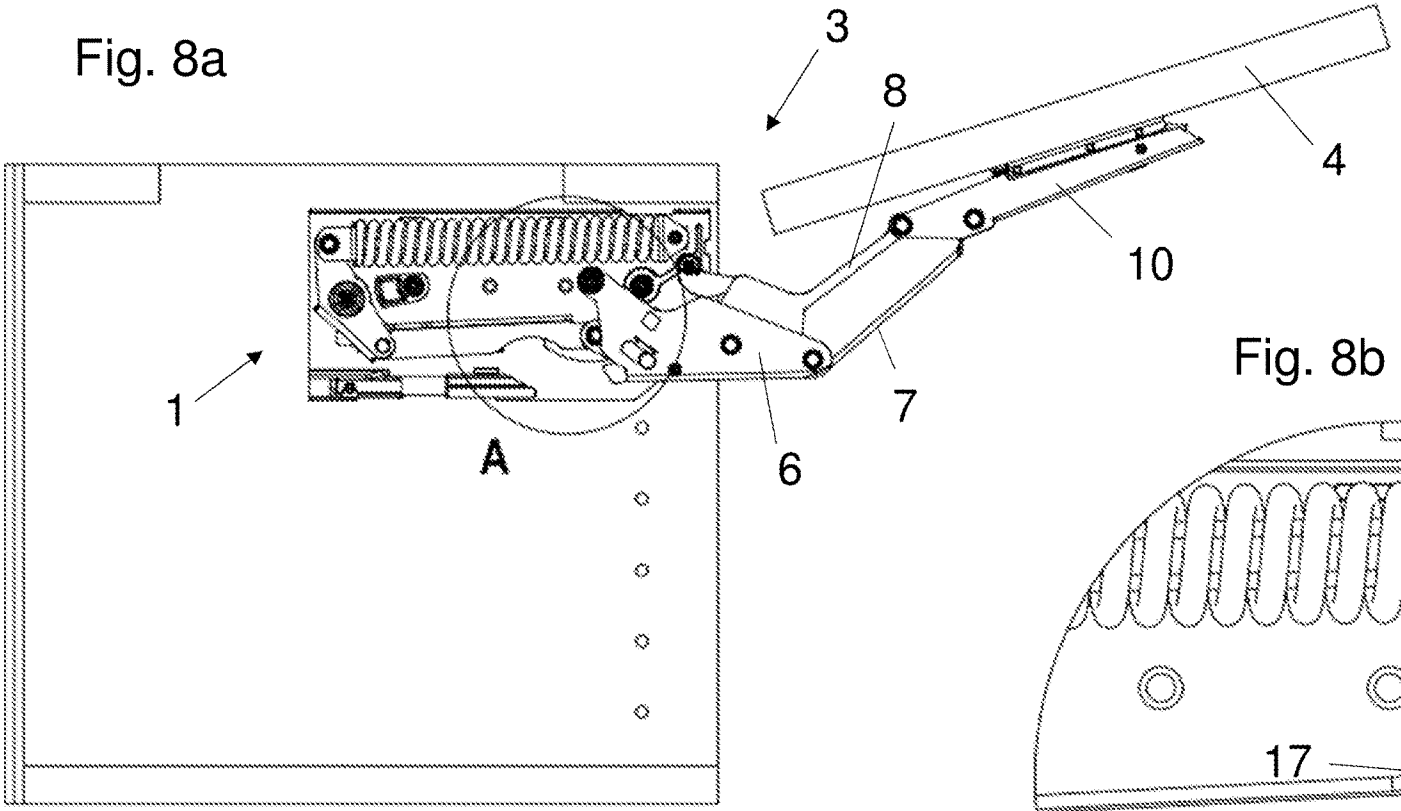
FIGS. 8*a* and 8*b* are a side view and a detail view of a piece of furniture with an actuating arm drive in a first setting.
Figure 8B:
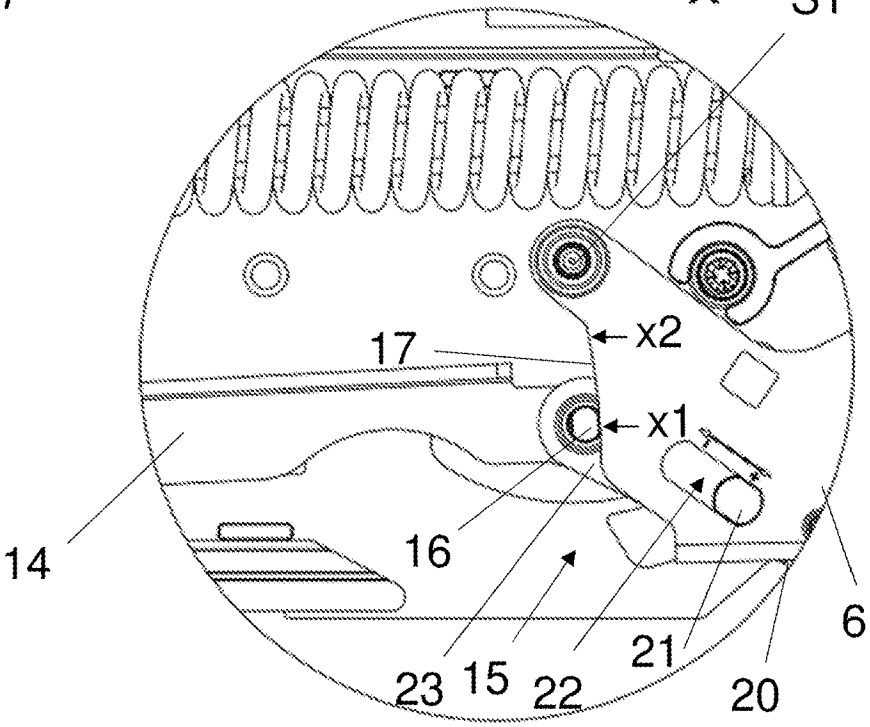

A side view and a detail view of a piece of furniture 3 with a substantially completely opened flap 4 is shown in FIG. 8*a* and FIG. 8*b*. As can be seen from the detail section A from FIG. 8*b*, the setting device 15 of the actuating arm drive 1 is in a first setting, in which the force-transmission element 16 transmitting the force from the energy storage mechanism 11 to the main arm 6 is located at a first force-transmission point x1 along the bearing contour 17 formed on the main lever 6. In this first setting of the setting device 15, as shown, the sliding block 21 displaceable by the threaded spindle in the guideway 22 is located at a first end of the guideway 22 remote from the bearing contour 17, whereby due to the connection existing via the connecting piece 23 between the sliding block 21 and the force-transmission element 16, the latter is positioned on the bearing contour 17 at a force-transmission point x1 remote from the pivot axis S1.

Figure 9A:
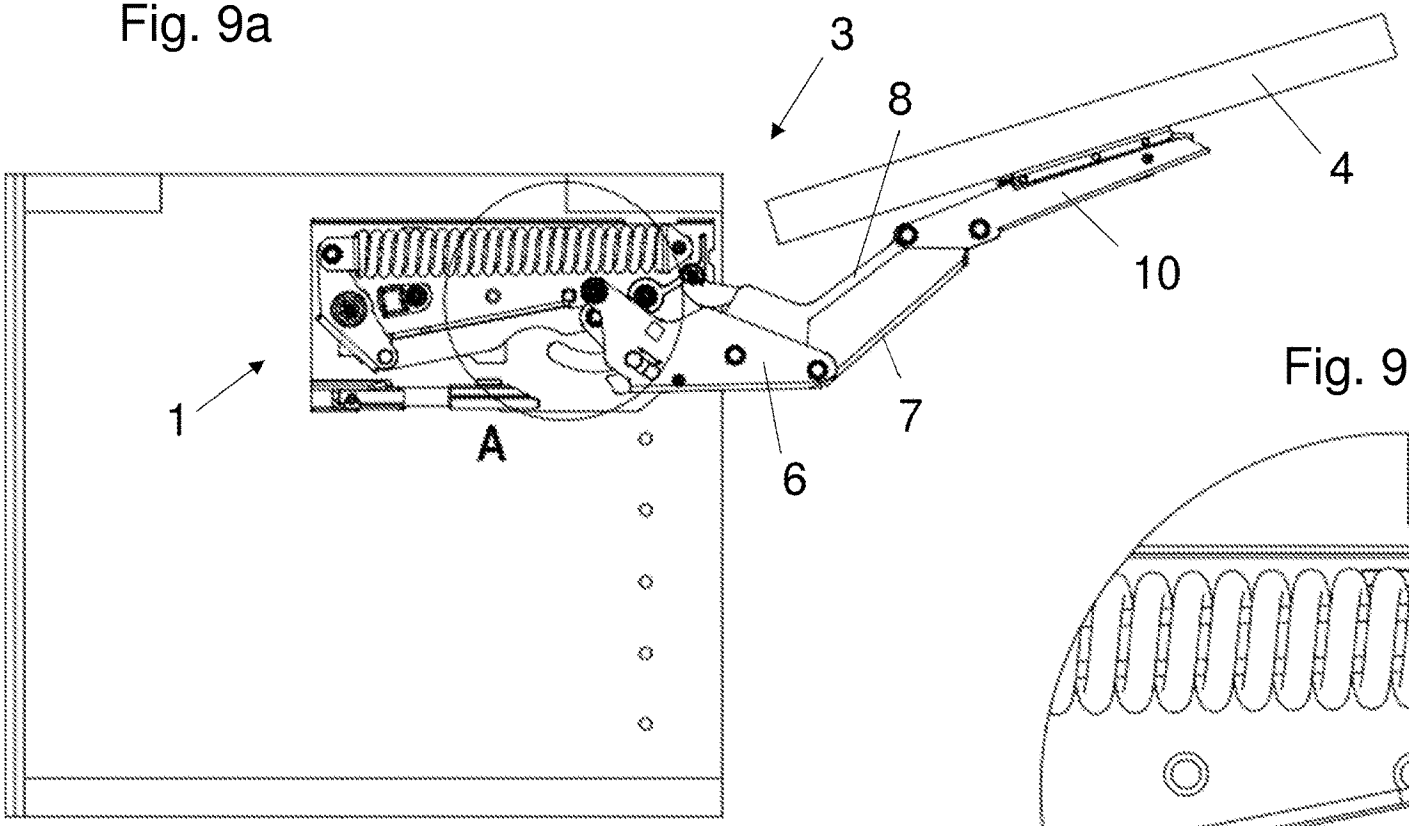
FIGS. 9*a* and 9*b* are a side view and a detail view of a piece of furniture with an actuating arm drive in a second setting and FIGS. 10*a* and 10*b* are a further side view and a detail view of a piece of furniture with an actuating arm drive in different settings.
Figure 9B:
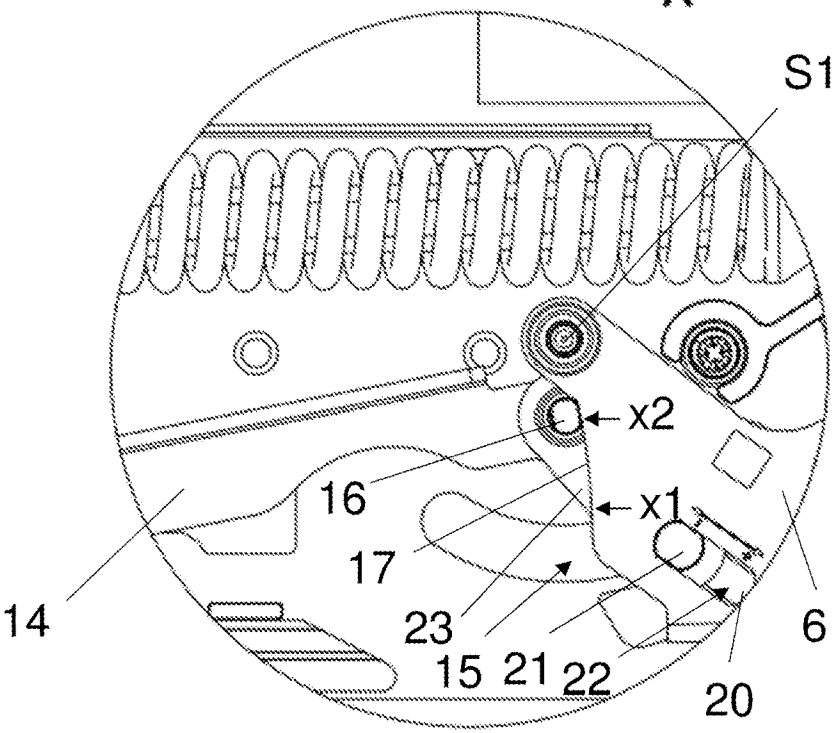

FIG. 9*a* and FIG. 9*b* show a side view and a detail view of a piece of furniture 3 with a substantially completely opened flap 4. As in the detail section A from FIG. 9*b*, the setting device 15 of the actuating arm drive 1 is in a second setting. In this second setting the sliding block 21 mounted on the threaded spindle 20 is located at a second end of the guideway 22 facing the bearing contour 17, whereby due to the connection existing via the connecting piece 23 between the sliding block 21 and the force-transmission element 16 the latter is positioned along the bearing contour 17 at a second force-transmission point x2 closer to the pivot axis S1. In contrast to the first setting (see FIG. 8*a* and FIG. 8*b*), in this second setting of the setting device 15 the torque exerted on the main lever 6 is minimal, which is why this setting is suitable for compensating for the weight of flaps 4 with low unladen weight.

It is clearly recognizable in FIGS. 8*a*, 8*b*, 9*a* and 9*b* here that the bearing contour 17 has a concavely curved progression, which runs substantially transversely to, and inclined towards, the line of action of the force from the energy storage mechanism 11 running along the transfer lever 14. Through the curved formation of the bearing contour 17, in the case of an adjustment of the setting device 15—and the associated adjustment of the force acting on the main arm 6 from the energy storage mechanism 11, the spring-loaded pre-tensioning of the spring 12 of the energy storage mechanism 11 remains substantially unchanged due to a pivoting of the transfer lever 14 associated with adjustment of the setting device 15. In addition, the force-transmission element 16 is always pushed along the bearing contour 17 in the same direction in every pivot position of the actuating arm drive 1 between the closed position and the open position, whereby undesired load reversals can be avoided during operation of the actuating arm drive 1. In the embodiments of the actuating arm drive shown in the preceding figures, this means specifically that the force-transmission element 16 is pushed along the bearing contour 17 substantially always in the direction of the pivot axis S1 in every pivot position of the actuating arm drive 1 between the open position and the closed position, whereby the setting device is always loaded by tension. If the direction in which the force-transmission element 16 is pushed along the bearing contour 17 is reversed, a change in direction of the loading (load reversal) specifically of the setting device 15 would occur, resulting in an undesired instability of the actuating arm drive 1 as well as potentially a noise generation by the actuating arm drive 1 constituted by a backlash.

Figure 10B:
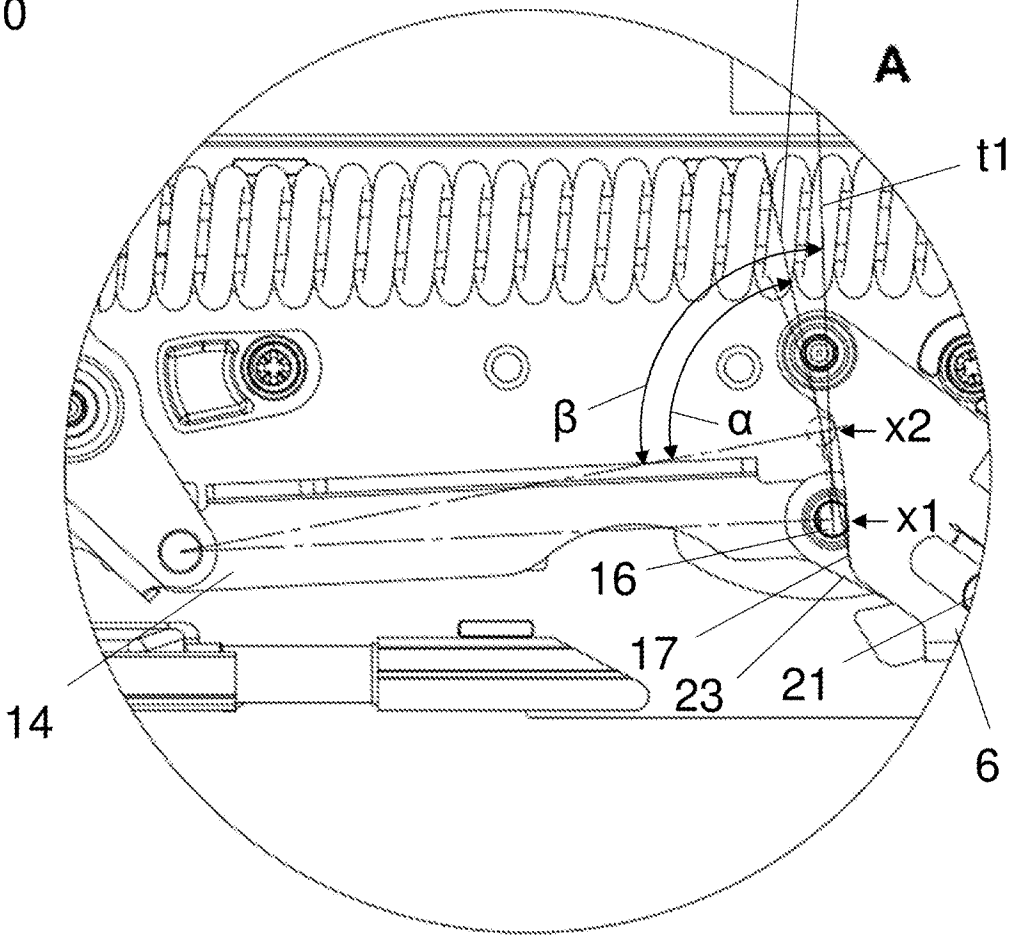
Figure 10A:
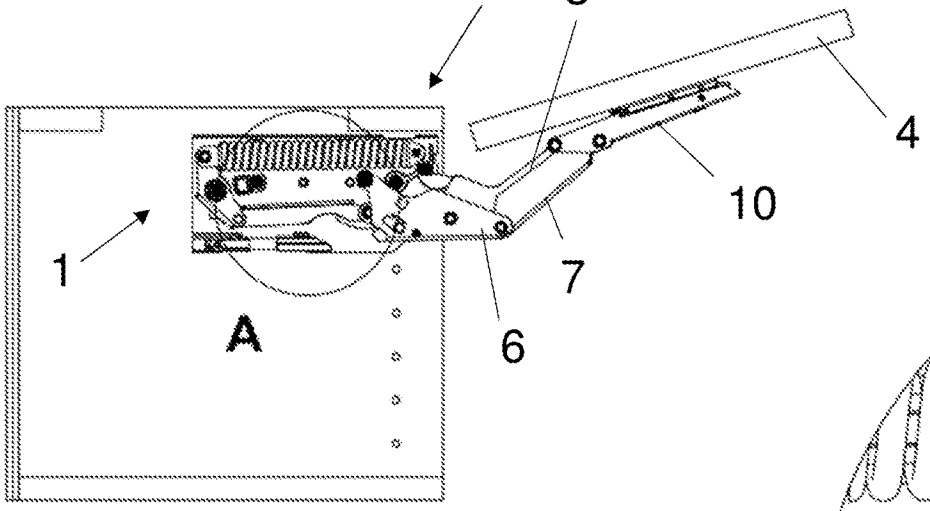

FIG. 10*a* and FIG. 10*b* show a side view and a detail view of a piece of furniture 3 with a flap 4 in the open position, in which the lines of action of the force acting on the main arm 6 from the energy storage mechanism 11 running along the transfer lever 14 are shown in the detail section A from FIG. 10*b*. In a first setting of the setting device 15, the force-transmission element 16 is located at a first force-transmission point x1 along the bearing contour 17. The tangent t1 illustrates the inclination of the bearing contour 17 at the first force-transmission point x1. If the bearing contour 17 is formed in a straight line, the force-transmission element 16 would be displaced along the tangent t1 during an adjustment of the setting device 15. At a second force-transmission point x2, an obtuse angle β (larger than 90°) would thus result between the line of action running towards the second force-transmission point x2 and the tangent on the bearing contour. If, on the other hand, the bearing contour 17 is formed curved, specifically bulging concavely towards the line of action of the force, the angle α formed by the line of action of the force in the force-transmission point x2 and the inclination of the bearing contour 17 illustrated by the tangent t2 is an acute angle (smaller than 90°).

The invention claimed is:

1. An actuating arm drive for moving a pivotably mounted actuating arm, the actuating arm drive comprising:

a plurality of levers including at least two levers connected to each other in an articulated manner, the plurality of levers including a first lever and a second lever arranged in parallel with a lateral spacing therebetween, each of the first lever and the second lever having a first axle hole and a second axle hole extending therethrough, the first axle hole and the second axle hole having respective centers spaced apart from each other at a first standard spacing;

a first axle pin projecting through the first axle hole of each of the first lever and the second lever; and a second axle pin projecting through the second axle hole of each of the first lever and the second lever;

wherein the plurality of levers further include a third lever having a first receiver for receiving the first axle pin and a second receiver for receiving the second axle pin, the third lever being arranged such that the first axle pin is at least partially received in the first receiver and the second axle pin is at least partially received in the second receiver, the first receiver and the second receiver of the third lever having respective centers spaced apart from each other at a second standard spacing, the second standard spacing being different than the first standard spacing when the third lever is in a relaxed state such that the third lever is stressed in an installed state.

2. The actuating arm drive according to claim 1, wherein each of the first lever and the second lever is substantially flat.

3. The actuating arm drive according to claim 1, wherein the first lever and the second lever are identical.

4. The actuating arm drive according to claim 1, wherein the third lever is substantially flat.

5. The actuating arm drive according to claim 1, wherein the third lever is elastically resilient.

6. The actuating arm drive according to claim 1, wherein the third lever has a spring constant in a range of from 50 N/mm to 250 N/mm.

7. The actuating arm drive according to claim 6, wherein the spring constant is in a range of from 100 to 150 N/mm.

8. The actuating arm drive according to claim 1, wherein the third lever has a substantially curved shape.

9. The actuating arm drive according to claim 8, wherein the third lever has a wavy shape.

10. The actuating arm drive according to claim 8, wherein the curvature of the third lever changes direction at least once.

11. The actuating arm drive according to claim 10, wherein the curvature of the third lever changes direction at least twice.

12. The actuating arm drive according to claim 1, wherein each of the first receiver and the second receiver of the third lever is one of an axle hole or an indentation.

13. The actuating arm drive according to claim 1, wherein the third lever is arranged between the first lever and the second lever.

14. The actuating arm drive according to claim 13, wherein the third lever is located entirely and completely between the first lever and the second lever.

15. The actuating arm drive according to claim 1, wherein the lateral spacing between the first lever and the second lever substantially corresponds to a thickness of the third lever.

16. The actuating arm drive according to claim 1, wherein a difference between the second standard spacing and the first standard spacing is in a range of from 1% to 10%.

17. The actuating arm drive according to claim 16, wherein the difference between the second standard spacing and the first standard spacing is in a range of from 5% to 10%.

18. The actuating arm drive according to claim 1, wherein a difference between the second standard spacing and the first standard spacing is in a range of from 0.1 mm to 5 mm.

19. The actuating arm drive according to claim 18, wherein the difference between the second standard spacing and the first standard spacing is in a range of from 0.1 mm to 1 mm.

20. The actuating arm drive according to claim 1, wherein the second standard spacing is larger than the first standard spacing.

21. The actuating arm drive according to claim 1, wherein a ratio of a height of the third lever to the second standard spacing of the third lever is 0.35 or less.

22. The actuating arm drive according to claim 21, wherein the ratio is 0.15 or less.

23. A piece of furniture comprising:

a furniture carcass;

a flap; and the actuating arm drive according to claim 1 mounted to the furniture carcass for driving the flap.

24. A method of producing the actuating arm drive according to claim 1, comprising pre-stressing the third lever by stretching or compression so that the second standard spacing becomes equal to the first standard spacing when the actuating arm drive is assembled, and so that the third lever retains this in the installed state.

25. The method according to claim 24, further comprising:

forming the first receiver of the third lever as an axle hole and the second receiver of the third lever as an indentation;

arranging the third lever between the first lever and the second lever;

introducing the first axle pin into the first axle hole of the first lever, the first axle hole of the second lever, and the axle hole of the third lever;

introducing a second axle pin into the second axle hole of the first lever and the second axle hole of the second lever; and pivoting the third lever onto the second axle pin by a pivoting movement, wherein the second axle pin is introduced into the indentation of the third lever by the pivoting.

* * * * *